United States Patent [19]

Itoh et al.

[11] 4,433,049

[45] Feb. 21, 1984

[54] METHOD FOR PREPARING A LIGHT-SENSITIVE CUPROUS HALIDE EMULSION

[75] Inventors: Noboru Itoh; Toshiaki Takahashi; Keiji Ogi; Atsushi Kamitakahara, all of Hino, Japan

[73] Assignee: Konishiroku Photo Industry Co., Ltd., Tokyo, Japan

[21] Appl. No.: 347,647

[22] Filed: Feb. 10, 1982

[30] Foreign Application Priority Data

Feb. 21, 1981 [JP] Japan ..... 56-24669

[51] Int. Cl.[3] ..... G03C 1/72

[52] U.S. Cl. ..... 430/495; 423/493

[58] Field of Search ..... 423/493; 430/495

[56] References Cited

U.S. PATENT DOCUMENTS 3,907,566 9/1975 Inoue et al. ..... 430/495

FOREIGN PATENT DOCUMENTS 950428 9/1956 Fed. Rep. of Germany .

OTHER PUBLICATIONS

Chem. Absts. vol. 42, 1203i–1204a –d.

*Primary Examiner*—Mary F. Downey

*Attorney, Agent, or Firm*—Frishauf, Holtz, Goodman & Woodward

[57] ABSTRACT

Disclosed is a method for preparing a light-sensitive cuprous halide emulsion which comprises reducing cupric ions by an ascorbic acid derivative represented by the general formula:

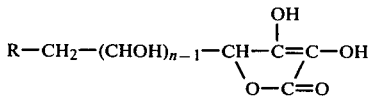

wherein R is a hydrogen atom or a hydroxyl group, and n is an integer of 1 to 4, provided that R is a hydroxyl group when n is 1, or its alkali metal salt, in the presence of halogen ions.

13 Claims, No Drawings

METHOD FOR PREPARING A LIGHT-SENSITIVE CUPROUS HALIDE EMULSION

The present invention relates to a method for preparing a novel photographic emulsion, and more particularly to a method for preparing a novel photographic emulsion using a cuprous halide.

Heretofore, as a photographic system requiring high sensitivity, there have been widely used common silver halide photographic systems. The silver halide photographic systems have their own features such as the high sensitivity, high quality, speedy treatment and dry treatment. In general, however, they require a considerable amount of silver since they use silver compounds as the light-sensitive substance and as the image forming substance (or as the intermediate medium for the formation of a colour image in the case of a silver halide colour photographic system).

On the other hand, in most cases i.e. except for some, the above photographic systems do not include means for recovery or reuse of the silver. This makes the silver halide photographic systems generally expensive ones and represents a drawback of the photographic systems using silver, since the shortage of silver resources is now a problem and the price of silver has rapidly been increased in recent years.

Accordingly, it is desired to develop a photographic system wherein the use of silver is minimal or a photographic system wherein no silver is used.

There have been reported a number of non-silver salt photographic systems, but they are generally inferior in sensitivity as compared with the photographic system using silver. Further, with a non-silver salt light-sensitive material, a continuous tone image is hardly obtainable. Among these non-silver salt photographic systems, there is a photographic system in which cuprous halide crystals are used and which provides a light-sensitive material having a relatively high sensitivity and capable of producing a continuous tone image. This photographic systems is reported in Research Disclosure Nos. 15166, 15251 and 15252.

The cuprous halide crystals have light-sensitivity. A light-sensitive material having such crystals on a support is radiated by ultraviolet ray and then developed with a physical or chemical developer to obtain a coloured image.

As a method for preparing a coating solution, it is known to disperse cuprous halide light-sensitive crystals in a binder. Firstly, as a method for preparing cuprous halide crystals, there is a method disclosed in "Inorganic Synthesis" Vol. 2, page 1 (1946) edited by R. N. Keller, and H. D. Wycoff, in which a cupric halide is reduced in an aqueous solution thereof by sodium sulfite, whereby crystals of cuprous halide are prepared by the following reaction:

$$2CuX_2+Na_2SO_3+H_2O\rightarrow 2CuX+Na_2SO_4+2HX.$$

The crystals of the cuprous halide prepared by this method are coarse. Accordingly, the crystals are then pulverized in a ball mill, and the cuprous halide crystal powder thereby obtained is dispersed in a solution prepared by dissolving a polymer compound such as cellulose acetate butyrate, or polyvinyl butyrate in an organic solvent such as acetone. The dispersion thereby obtained is coated on a support to obtain a light-sensitive film.

This method thus involves pulverization of coarse crystals of cuprous halide into fine particles. Accordingly, this method has drawbacks such that (1) it takes a long period of time for the pulverization treatment to obtain fine particles, (2) the grain size distribution of the crystals of the cuprous halide obtained by such pulverization is so wide that the image obtained by development gives extremely soft tone and low contrast, and (3) the image obtained by development has poor graininess.

On the other hand, in "Prace Komisji Mat Przyrod" Vol. 7 (No. 4), pages 3 to 12 (1956), Antoni Gulecki and Jan Wojtezak report that in an aqueous gelatin solution containing copper sulfate and potassium iodide, $Cu^{2+}$ ions are reduced by sodium sulfite to obtain CuI crystals and at the same time, the crystals thereby formed can be dispersed in the gelatin.

However, this method has drawbacks such that (1) when the cupric halide is reduced by sodium sulfite, a great amount of sulfur dioxide is generated, (2) in the method for reducing a cupric halide by sodium sulfite, the cuprous halide crystals thereby formed are likely to readily grow and tend to form coarse crystals, and (3) since the crystals of the cuprous halide are coarse, the grain size distribution of the cuprous halide crystals is so wide that the image obtained by development gives low contrast and poor graininess as is the case in the above mentioned method disclosed in Research Disclosure No. 15166.

Accordingly, a primary object of the present invention is to provide a method for preparing an emulsion comprising cuprous halide crystals which are fine grains and which have a narrow grain size distribution.

A secondary object of the present invention is to provide a method for preparing a cuprous halide emulsion which is capable of forming a developed image having a high contrast and superior graininess.

A third object of the present invention is to provide a method for preparing a cuprous halide emulsion, which does not generate a toxic gas or a gas having irritating odor during the preparation.

As a result of intensive researches conducted by the present inventors, it has been found that the objects of the present invention can be achieved by a method for preparing a light-sensitive cuprous halide emulsion which comprises reducing cupric ions by an ascorbic acid derivative represented by the following general formula or its alkali metal salt in the presence of halogen ions:

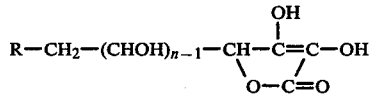

wherein R is a hydrogen atom or a hydroxyl group, and n is an integer of 1 to 4, provided that R is a hydroxyl group when n is 1.

Now, the method of the present invention will be described in further detail.

Firstly, as specific examples of the ascorbic acid derivative represented by the above general formula and its alkali metal salt, which is used as a reducing agent for copper ions in the present invention, there may be mentioned L-ascorbic acid, araboascorbic acid, 1-erythroascorbic acid and d-glucoascorbic acid. However, it is particularly preferred to use L-ascorbic acid or its alkali metal salt. As alkali metal to form the alkali metal salt, there may be mentioned Zi, Na and K; from a practical point of view Na or K is more preferable. The amount thereof is within a range of from 30 to 300 molar %, preferably from 70 to 250 molar %, relative to the concentration of the cupric ions to be reduced. If the amount is less than 30 molar %, a part of the copper ions will remain without being reduced, and the supernatant after the reaction exhibits a blue colour. On the other hand, if the amount exceeds 300 molar %, the cupric ions are likely to be reduced to metal copper.

The ascorbic acid derivative or its alkali metal salt which is used in the present invention does not generate a toxic gas during the reduction reaction of the cupric ions, and thus it is possible to prepare the cuprous halide crystals quite safely as compared with the reduction reaction by a sulfite or a nitrite. Further, the reduction reaction by a sulfite or a nitrite requires strong acidity. Whereas the reduction reaction by the ascorbic acid derivative or its alkali metal salt is not very much influenced by the pH as the reaction is an oxidation reduction reaction by electron transfer within a copper-ascorbic acid complex. Accordingly, an aqueous solution of the ascorbic acid derivative or its alkali metal salt may simply be mixed with an aqueous solution containing the cupric ions. Thus, the method of the present invention has an advantage that the pH of the liquid phase in which the reduction reaction takes place to form cuprous halide crystals, may be selected from a wide range of from 1 to 7 for the preparation of the crystals.

According to the present invention, when cuprous halide crystals are prepared by reducing the cupric ions by the ascorbic acid derivative or its alkali metal salt in the presence of halogen ions, no protective colloid may be incorporated in the liquid phase in which the reduction reaction takes place. However, the reduction reaction is preferably carried out in the liquid phase containing from 0.1 to 5% by weight of a protective colloid. In this case, if the amount of the protective colloid is less than 0.1 wt. %, the cuprous halide crystals thereby formed tend to form aggregates. On the other hand, if the amount exceeds 5 wt. %, the stirring efficiency of the liquid phase is reduced leading to the formation of coarse crystals.

As the protective colloid to be used in the present invention, there may be mentioned hydrophilic polymer compounds, for instance, natural polymer compounds such as gelatin, gelatin derivatives, gum arabic, alubumin or agar, and synthetic polymer compounds such as polyvinylalcohol, polyvinylpyrrolidone, cellulose ether, or partially hydrolyzed cellulose acetate. They may be optionally used alone or in combination.

According to the present invention, the reduction reaction is carried out in the presence of halogen ions. This can be done by incorporating e.g. an alkali metal salt of chlorine, bromine or iodine in the solution for the reduction reaction.

In this case, the amount of halogen ions may prefarably be at least a half of a stoichiometrically equivalent amount with respect to the cupric ions and is generally from 100 to 400 molar %, preferably from 120 to 350 molar %.

On the other hand, as a compound to provide the cupric ions, there may be used a water soluble inorganic copper salt such as copper nitrate, copper sulfate or a cupric halide such as cupric chloride or cupric bromide.

In the present invention, a dispersion of cuprous halide crystals in the protective colloid, thus obtained, is referred to as a cuprous halide emulsion. In this case, the halogen component of the cuprous halide is at least one of chlorine, bromine and iodine. Such halogens may be employed alone or in combination (i.e. a mixture or mixed crystal of cuprous halides).

In the preparation of the cuprous halide emulsion of the present invention, the mixing operation can be conducted by various mixing methods such as a regular mixing method, an inverted mixing method or a simultaneous mixing method. Further, physical ageing may also be conducted. A satisfactory cuprous halide emulsion can be obtained by carrying out the mixing and the ageing at a temperature of from 25° to 70° C.

The cuprous halide emulsion thus prepared may be treated in the same manner as the conventional silver halide emulsions by subjecting it to washing and demineralization treatments by means of e.g. gelation, dialysis or a coagulation method, as the case requires. Such treatments are described in detail, for instance, in "Shashin Kogaku no Kiso" ("Fundamentals of Photographic Engineering") compiled by Japan Photographic Academy, and published by Corona Co., in 1979.

As described in detail in the foregoing, in the method for preparing a light-sensitive cuprous halide emulsion according to the present invention, the cupric ions are reduced by the ascorbic acid derivative or its alkali metal salt in the presence of halogen ions. This reduction reaction takes place only when there exist three fundamental materials, i.e. the ascorbic acid derivative or its alkali metal salt as the reducing agent, the cupric ions and the halogen ions. The present invention covers any means for mixing the three materials to initiate the above reduction reaction. Preferred embodiments among them will be given below.

(1) A cupric halide, for instance, cupric bromide is dissolved in an aqueous gelatin solution. While heating and stirring the solution, an aqueous L-ascorbic acid solution is added (preferably instantaneously) thereto, and physical ageing is conducted. Then, demineralization and washing are conducted in accordance with conventional methods, and the precipitates thereby obtained are dispersed in a protective colloid, whereupon a light-sensitive cuprous halide emulsion is obtained.

(2) Potassium chloride, potassium bromide and copper nitrate are dissolved in an aqueous gelatin solution. While heating and stirring the solution, an aqueous L-ascorbic acid solution is added (preferably instantaneously) thereto, and physical ageing is conducted. Thereafter, treatments are conducted in the same manner as in the above embodiment (1), whereby a desired light-sensitive emulsion is obtained.

(3) L-Ascorbic acid and copper nitrate are dissolved in an aqueous gelatin solution. While heating and stirring the solution, an aqueous solution containing potassium bromide and potassium iodide is added (preferably instantaneously) and physical ageing is conducted. Thereafter, treatments are conducted in the same manner as in the above embodiment (1), whereby a light-sensitive emulsion is obtained.

(4) Potassium bromide, potassium iodide and L-ascorbic acid are dissolved in an aqueous gelatin solution. While heating and stirring the solution, an aqueous copper sulfate solution is added (preferably instantaneously) thereto, and physical ageing is conducted. Thereafter, treatments are conducted in the same manner as in the above embodiment (1), whereby a light-sensitive emulsion is obtained.

(5) While heating and stirring an aqueous gelatin solution, a solution haveing dissolved therein potassium bromide, potassium iodide and L-ascorbic acid, is added thereto in a long period of time, and while further heating and stirring the solution thereby obtained, an aqueous copper sulfate solution is dropwise added in a long period of time. After the completion of the dropwise addition, the reaction mixture is immediately subjected to treatments in the same manner as in the above embodiment (1), whereby a desired light-sensitive emulsion is obtained in the same manner as the foregoing.

When the cuprous halide emulsion of the present invention is applied to a support, if a binder is required for the formation of a layer, there may be used as the binder the same hydrophilic polymer compounds as the above mentioned protective colloid.

The emulsion prepared by the method of the present invention may be applied on or absorbed by a support to form a light-sensitive material. As the support to be used there may be employed, for instance, a porous support such as paper which is suitable for absorbing the emulsion. Other than this, a variety of supports such as glass, a metal sheet, a synthetic resin film, baryta paper or resin modified paper may also be used.

The light-sensitive material having a cuprous halide emulsion of the present invention absorbed or coated on a support does not usually have light-sensitivity in a dried state. However, when the method disclosed in Research Disclosure 15166 (1976), 15251 (1976), 15252 (1976) and 15959 (1976) is applied, i.e. when after immersing the above light-sensitive material in an aqueous triethylenetetramine solution for 5 seconds to 1 minute, image forming exposure is conducted in a wet state with use of a light source having a wave length of from 260 to 450 mμ, and development is conducted with use of a developer, a stable image having high contrast, superior graininess and a neutral colour tone, is obtainable.

As described in detail in the foregoing, in the method of the present invention which has been improved over the conventional method for producing cuprous halide crystals, it is possible to prepare a light-sensitive emulsion comprising cuprous halide crystals which are fine grains and which have a narrower grain size distribution than the emulsion obtainable by the known methods, for instance, the fluctuation coefficient of the grain size distribution being not more than 80%, without generation of a toxic gas having an irritating odor during the reduction reaction. The light-sensitive material obtained by applying such an emulsion to a support, is capable of forming an image having high contrast and superior graininess.

Further, the emulsion of the present invention comprising such fine grains and having a narrow grain size distribution, has a feature that even when subjected to fixing treatment by means of a solubilizer (e.g. a thiosulfate, or thiocyanate) for a cuprous halide, it is free from a decrease in the image density which may occur in the case of the emulsion obtained by the conventional methods. This is believed to be due to the fact that the cuprous halide grains in the emulsion of the present invention are composed substantially of particles having a particle size of not more than 10μ.

Now, the method for preparing cuprous halide emulsions according to the present invention will be specifically described with reference to Examples.

EXAMPLE 1

A cuprous bromide emulsion was prepared with use of solutions having the following compositions.

Solution 1:
Ossein gelatin—50 g
Distilled water—1.0 l
Cupric bromide—200 g
Solution 2:
L-Ascorbic acid—180 g
Pure water—1.0 l (pH: 2.3)

While stirring the Solution 1 at a temperature of 35° C., the Solution 2 was instantaenously added, whereupon the reaction started, and the pH at the initiation of the reaction was 2.8. The pH gradually decreased as the formation of the cuprous bromide crystals proceeded. The stirring was continued for 10 minutes while maintaining the temperature at the initial level, i.e. 35° C. Two minutes after the initiation of the precipitation reaction, the pH of the solution became 1.5 and was stabilized. Thereafter, demineralization and washing operations were carried out in the following manner. As precipitation reagents, an aqueous solution containing 5% of Demol N manufactured by Kao Atlas Co. and an aqueous solution containing 30% of magnesium sulfate were added in a ratio of 1:7 until the precipitates formed. After settling the precipitates, the supernatant was decanted and 3000 ml of distilled water added to redisperse the precipitates. A 30% magnesium sulfate aqueous solution was again added until the precipitates formed. After settling the crystal grains, the supernatant was decanted, and an aqueous ossein gelatin solution (containing 45 g of gelatin) was added and stirred at 40° C. for 30 minutes to disperse the crystal grains. Then, distilled water was added to have the total volume adjusted to 1000 ml. This emulsion will hereinafter be referred to as EM-1.

From the electron microscopic photography, it was found that the average grain size of this EM-1 was 0.5±0.2μ.

EXAMPLE 2

A cuprous bromide emulsion was prepared with use of solutions having the following compositions.

Solution 3:
Ossein gelatin—50 g
Distilled water—1.0 l
Cupric bromide—150 g
Solution 4:
L-Ascorbic acid—82 g
Pure water—1.0 l The Solutions 3 and 4 were respectively adjusted to a pH of 7 with a dilute NaOH aqueous solution. While stirring the Solution 3 at a temperature of 35° C., the Solution 4 was instantaneously added thereto, and the stirring was continued for 10 minutes. About 2 minutes after the initiation of the reaction, the pH of the solution became 5 and was stabilized. Thereafter, washing and demineralization operations were conducted in a manner similar to Example 1. Then, an aqueous ossein gelatin solution (containing 37.5 g of gelatin) was added and stirred at 35° C. for 30 minutes for dispersion, and distilled water was added to have the total volume adjusted to 1875 ml. This emulsion will hereinafter be referred to as EM-2. From the electron microscopic photography, it was found that the average grain size of this EM-2 was $0.5\pm0.2\mu$.

EXAMPLE 3

A cuprous bromide emulsion was prepared with use of solutions having the following compositions.

Solution 5:
- Ossein gelatin—30 g
- Distilled water—1.0 l
- Cupric bromide—200 g Solution 6:
- L-Ascorbic acid—130 g
- Pure water—1.0 l The Solutions 5 and 6 were respectively adjusted to a pH of 6 with a dilute NaOH aqueous solution and a dilute sulfuric acid. While stirring the Solution 5 at a temperature of 35° C., the Solution 6 was added instantaneously thereto, and the stirring was continued for 10 minutes to form cuprous bromide crystals. The crystal formation was carried out while maintaining the pH of the solution at 5.5 by adding a dilute NaOH aqueous solution to compensate the decrease of the pH due to the reduction of the cupric ions. Thereafter, washing and demineralization operations were carried out in a manner similar to Example 1. After the washing and demineralization treatments, an aqueous ossein gelatin solution (containing 50 g of gelatin) was added and stirred at 40° C. for 30 minutes for dispersion, and distilled water was added to have the total volume adjusted to 1000 ml. This emulsion will hereinafter be referred to as EM-3. From the electron microscopic photography, it was found that the average grain size of this EM-3 was $0.8\pm0.3\mu$.

EXAMPLE 4

A copper iodobromide emulsion was prepared with use of solutions having the following compositions.

Solution 7:
- Ossein gelatin—40 g
- Distilled water—1.0 l
- L-Ascorbic acid—150 g
- $Cu(NO_3)_2\ 3H_2O$—210 g
- (The pH of this solution was adjusted to 7.0 with a dilute NaOH aqueous solution)

Solution 8:
- KBr—123 g
- KI—3.7 g
- $H_2O$—1.0 l

While stirring the Solution 7 at a temperature of 35° C., the Solution 8 was added instantaneously thereto, and the stirring was continued for 10 minutes. Thereafter, washing and demineralization operations were carried out in a manner similar to Example 1. After the washing and demineralization treatments, an aqueous ossein gelatin solution (containing 50 g of gelatin) was added and stirred at 35° C. for 30 minutes for dispersion, and distilled water was added to have the total volume adjusted to 1000 ml. This emulsion will hereinafter be referred to as EM-4.

This EM-4 was examined by an elemental analysis for the composition of the copper iodobromide, and it was found that it contained 97.5 molar % of $Br^-$ and 2.5 molar % of $I^-$. Further, from the electron microscopic photography, this EM-4 was found to have an average grain size of $0.9\pm0.3\mu$.

EXAMPLE 5

Copper chlorobromide crystals were prepared with use of solutions having the following compositions.

Solution 9:
- Ossein gelatin—30 g
- Distilled water—1.0 l
- KCl—29.5 g
- KBr—16 g
- $Cu(NO_3)_2\ 3H_2O$—105 g Solution 10:
- L-Ascorbic acid—80 g
- $H_2O$—500 ml While stirring the Solution 9 at a temperature of 40° C., the Solution 10 was added instantaneously, and the stirring was continued for 20 minutes. Thereafter, washing and demineralization treatments were carried out in a manner similar to Example 1. After the washing and demineralization treatments, an aqueous ossein gelatin solution (containing 60 g of gelatin) was added and stirred at 40° C. for 30 minutes for dispersion, and distilled water was added to have the total volume adjusted to 1000 ml. This emulsion will hereinafter be referred to as EM-5. This emulsion was examined by an elemental analysis for the composition of the copper chlorobromide, and it was found that it contained 74.2 molar % of $Cl^-$ and 25.8 molar % of $Br^-$. Further, from the electron microscopic photography, the emulsion was found to have an average grain size of $0.9\pm0.3\mu$.

EXAMPLE 6

A copper iodobromide emulsion was prepared with use of solutions having the following compositions.

Solution 11:
- Pure water—1000 ml
- KBr—57.5 g
- KI—3.7 g
- Ascorbic acid—60 g
- Ossein gelatin—50 g Solution 12:
- $CuSO_4$—70.0 g
- Pure water—1000 ml While adequately stirring the Solution 11 at a temperature of 50° C., the Solution 12 was added thereto in 20 minutes, and crystals of copper iodobromide were prepared. After completion of the addition of the Solution 12, washing and demineralization treatments were carried out in a manner similar to Example 1. After the washing and demineralization treatments, an aqueous ossein gelatin solution (containing 50 g of gelatin) was added and stirred at 40° C. for 30 minutes, and distilled water was added to have the total volume adjusted to 1000 ml. This emulsion will hereinafter be referred to as EM-6. This emulsion was examined by an elemental analysis for the halogen composition of the copper iodobromide crystals and it was found that the emulsion contained 96.9 molar % of $Br^-$ and 3.1 molar % of $I^-$. Further, from the electron microscopic photography, this EM-6 was found to have an average grain size of $0.7\pm0.3\mu$.

EXAMPLE 7

A copper iodobromide emulsion was prepared with use of solutions having the following compositions.

Solution 13:
Pure Water—1000 ml
Gelatin—50 g
Solution 14:
Pure water—1575 ml
KBr—85.7 g
KI—2.2 g
L-Ascorbic acid—79.2 g
Solution 15:
Pure water—2000 ml
$Cu(NO_3)_2\ 3H_2O$—106 g While maintaining the Solution 13 at a temperature of 45° C., the Solution 14 was added and 5 seconds after the initiation of the addition of the Solution 14, the Solution 15 was added. The Solution 14 was added in 20 minutes and the Solution 15 was added in 21 minutes. The temperature during the physical ageing was kept at 45° C. After completion of the addition of the Solution 15, washing and demineralization treatments were immediately carried out in a manner similar to Example 1. After the treatments, an aqueous ossein gelatin solution (containing 46 g of gelatin) was added and stirred at 40° C. for 30 minutes for redispersion, and distilled water was added to have the total volume adjusted to 1000 ml. This emulsion will hereinafter be referred to as EM-7. This emulsion was examined by an elemental analysis for the halogen composition of the copper iodobromide crystals, and it was found that this emulsion contained 96.2 molar % of $Br^-$ and 3.8 molar % of $I^-$. Further, from the electron microscopic photography, it was found that the average grain size of the copper iodobromide crystals of this EM-7 was $0.4\pm0.1\mu$.

Comparative Example 1

Cuprous bromide crystals were prepared with use of solutions having the following compositions.

Solution 16:
Pure water—1000 ml
Cupric bromide—100 g
Conc. $H_2SO_4$/pure water=(1/1)—50 ml
Solution 17:
Pure water—1000 ml
Anhydrous sodium sulfite—95 g While stirring the Solution 16 at a temperature of 35° C., the Solution 17 was added instantaneously thereto, and the stirring was continued for 10 minutes while maintaining the temperature during the reaction at 35° C. Thereafter, when left to stand still, white crystals of cuprous bromide precipitated, and the supernatant was slightly coloured blue. This supernatant was decanted. Then, the crystals were washed with water acidified with acetic acid, and after washing with acetone the crystals were dried. The white powder thereby obtained was observed by an electron microscope, and found to have an average grain size of $50\pm30\mu$. These cuprous bromide crystals were pulverized by a ball mill for 5 hours, and then subjected to dispersion treatment for one hour after addition of 100 ml of a 5% gelatin aqueous solution. The pulverized crystals in the dispersion were observed by an electron microscope and found to have an average grain size of $10\pm7\mu$. To this dispersion, 900 ml of a 5% gelatin aqueous solution was further added to have the total volume adjusted to 1000 ml. This emulsion will hereinafter be referred to as EM-8.

Comparative Example 2

A cuprous bromide emulsion was prepared with use of solution having the following compositions.

Solution 18:
Pure Water—1000 ml
Ossein gelatin—50 g
Cupric bromide—100 g
Conc. $H_2SO_4$/pure water=(1/1)—50 ml
Solution 19:
Pure water—1000 ml
Anhydrous sodium sulfite—95 g While stirring the Solution 18 at a temperature of 35° C., the Solution 19 was added instantaneously thereto, and the stirring was continued for 10 minutes while maintaining the temperature during the reaction at 35° C. Thereafter, washing and demineralization treatments were carried out in a manner similar to Example 1. After the treatments, 500 ml of an aqueous ossein gelatin solution (containing 50 g of gelatin) was added and stirred at 40° C. for 30 minutes for redispersion, and distilled water was added to have the total volume adjusted to 1000 ml.

This emulsion will hereinafter be referred to as EM-9. From the electron microscopic photography, this emulsion was found to have an average grain size of $50\pm20\mu$.

EXAMPLE 8

The chemically non-sensitized emulsions of EM-1 to EM-9 were respectively prepared so that the ratio of the gelatin to the cuprous halide became to be 8:1 and the gelatin concentration became to be 4%, and then coated on a film support so that the amount of the coated copper became to be 2500 mg/cm$^2$. The samples thereby obtained were immersed and treated in a developer having the following composition at 20° C. for 30 seconds, and then exposed for $10^4$ erg/cm$^2$ through an optical wedge with use of a light source having an ultraviolet ray having a wave length within a range of 260 to 420 nm. Thereafter, they were subjected to development treatment by a developer having the following composition at 20° C. for 5 minutes. Then, they were subjected to fixing and washing treatments.

Composition of the developer:
Triethylenetetramine—365 g
Pure water—1000 ml
Fixing Solution:
Hypo—240 g
Sodium sulfite—10 g
Sodium hydrogensulfite—25 g
Water—To make up 1000 ml The results obtained from the sensitometry are shown in Table 1. It is seen that in the cases of the Examples according to the present invention, higher $D_{max}$ and lower $D_{min}$ are obtainable as compared with the Comparative Examples. Further, in the case of Comparative Example 1, especially $\gamma$ is small and the contrast is low, and in the case of Comparative Example 2, the contrast is likewise low. Also in these cases, the density of the black images is low and the graininess of the images is extremely inferior. Whereas, with the light-sensitive materials of EM-1 to EM-7 prepared with use of L-ascorbic acid, photographic images wherein the contrast is high and the graininess of the black images is extremely good, are obtainable.

TABLE 1

| Samples No. | EM No. | $D_{min}$ | $D_{max}$ | $\gamma$ | Graininess of the photographic image |
|---|---|---|---|---|---|
| 1 | EM-1 (Present invention) | 0.7 | 2.0 | 0.6 | good |
| 2 | EM-2 (Present invention) | 0.7 | 2.0 | 0.6 | good |
| 3 | EM-3 (Present invention) | 0.7 | 2.1 | 0.7 | good |
| 4 | EM-4 (Present invention) | 0.6 | 1.8 | 0.8 | good |
| 5 | EM-5 (Present invention) | 0.6 | 2.2 | 0.6 | good |
| 6 | EM-6 (Present invention) | 0.5 | 2.8 | 0.8 | excellent |
| 7 | EM-7 (Present invention) | 0.6 | 2.7 | 0.7 | excellent |
| 8 | EM-8 (Comparative Example) | 1.4 | 1.9 | 0.2 | extremely coarse |
| 9 | EM-9 (Comparative Example) | 1.0 | 1.5 | 0.4 | coarse |

The above $\gamma$ was taken from an inclination of (Fog+0.1) to (Fog+0.3) of the sensitometric curve.

We claim:

1. A method for preparing a light-sensitive cuprous halide emulsion which comprises reducing cupric ions in a liquid phase with an ascorbic acid derivative represented by the formula:

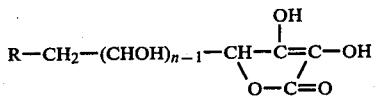

wherein R is a hydrogen atom or a hydroxyl group, and n is an integer of 1 to 4, provided that R is a hydroxyl group when n is 1, or alkali metal salts thereof, in the presence of halogen ions and from 0.1 to 5% by weight of a protective colloid.

2. The method of claim 1, wherein said ascorbic acid derivative is selected from the group consisting of L-ascorbic acid, araboascorbic acid, 1-erythroascorbic acid and d-glucoascorbic acid and alkali metal salts thereof.

3. The method of claim 2, wherein said ascorbic acid derivative is L-ascorbic acid or an alkali metal salt thereof.

4. The method of claim 1, wherein said cupric ions are obtained from a compound selected from the group consisting of copper nitrate, copper sulfate, cupric chloride and cupric bromide.

5. The method of claim 1, wherein said protective colloid is at least one compound selected from the group consisting of gelatin, gelatin derivatives, gum arabic, albumin, agar, polyvinylalcohol, polyvinylpyrrolidone and cellulose ether.

6. The method of claim 1, wherein the reduction reaction is carried out at a temperature of from 25° to 70° C.

7. The method of claim 1, wherein the reduction reaction is carried out at a pH value ranging from 1 to 7.

8. The method of claim 1, wherein the cuprous halide is at least one compound selected from the group consisting of cuprous chloride, cuprous bromide, cuprous iodide and mixed crystals thereof.

9. The method of claim 1, wherein the alkali metal is selected from the group consisting of sodium and potassium.

10. The method of claim 1, wherein the amount of the alkali metal is 30 to 300 molar % relative to the concentration of the cupric ions.

11. The method of claim 1, wherein the amount of the halogen ions is 100 to 400 molar % relative to the concentration of the cupric ions.

12. The method of claim 1, wherein said emulsion comprises cuprous halide in the form of grains a substantial portion of which has a particle size of up to 10 microns.

13. A method for preparing a light-sensitive cuprous halide emulsion which comprises reducing cupric ions in a liquid phase at a temperature of from 25° to 70° C. at a pH in the range of from 1 to 7 with an ascorbic acid derivative represented by the formula:

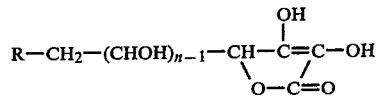

wherein R is a hydrogen atom or a hydroxyl group, and n is an integer of 1 to 4, provided that R is a hydroxyl group when n is 1, or alkali metal salts thereof, in the presence of halogen ions and from 0.1 to 5% by weight of a protective colloid selected from the group consisting of gelatin, gelatin derivatives, gum arabic, albumin, agar, polyvinylalcohol, polyvinylpyrrolidone and cellulose ether, wherein when the ascorbic acid derivative is an alkali metal salt, the amount of the alkali metal is 30 to 300 molar % relative to the concentration of cupric ions, and wherein the amount of the halogen ions is 100 to 400 molar % relative to the concentration of the cupric ions, said emulsion comprising cuprous halide in the form of grains a substantial portion of which has a particle size of up to 10 microns.

* * * * *